United States Patent [19]

Bennett

[11] 4,023,516

[45] May 17, 1977

[54] SHIP STABILIZING SYSTEMS

[75] Inventor: David Alexander Bennett, Bracknell, England

[73] Assignee: Sperry Rand Corporation, New York, N.Y.

[22] Filed: Aug. 8, 1975

[21] Appl. No.: 602,939

[30] Foreign Application Priority Data

Aug. 20, 1974 United Kingdom ..... 36535/74

[52] U.S. Cl. ..... 114/126

[51] Int. Cl.[2] ..... B63B 39/06

[58] Field of Search ..... 114/121, 122, 126; 74/501 R

[56] References Cited

UNITED STATES PATENTS

| | | | |
|---|---|---|---|
| 2,960,959 | 11/1960 | Chadwick, Jr. et al. | 114/126 |
| 2,979,010 | 4/1961 | Braddon et al. | 114/126 |
| 3,020,869 | 2/1962 | Beach | 114/126 |
| 3,320,665 | 5/1967 | Morse | 74/501 X |

*Primary Examiner*—Trygve M. Blix
*Assistant Examiner*—Sherman D. Basinger
*Attorney, Agent, or Firm*—Howard P. Terry

[57] ABSTRACT

A ship stabilizing system of the activated-fin type in which each fin has a shaft mounted within a casing adapted for rotation on movement of the fin to and from the operative position, the casing being mounted for rotation in upper and lower bearings so dimensioned that access can be gained therethrough to the fin shaft and associated components mounted within the casing.

8 Claims, 12 Drawing Figures

SHIP STABILIZING SYSTEMS

Figure 1:
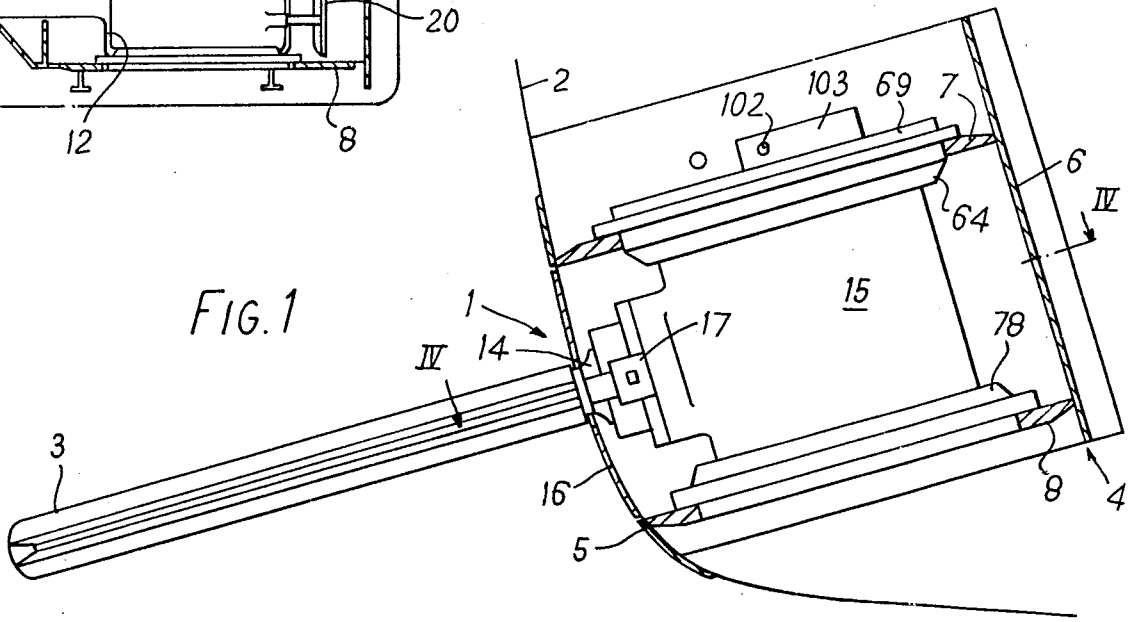

This invention relates to ship stabilising systems and more particularly to such systems of the activated-fin type in which the fins are movable to and from an operative position about a generally vertical axis.

In U.S. Pat. No. 2,979,010 entitled "Ship Stabilization System" issued Apr. 11, 1961 in the names of F. D. Braddon et al, there is disclosed an activated fin ship stabilising system in which each of two fins positioned on opposed sides of the ship comprises a main body of aerofoil section and a shaft provided at the inner end of the fin about the axis of which the fin can be tilted in one direction or another to vary the lifting force imparted by the fin to the ship. Each fin normally extends downwardly at a small angle to the horizontal in the operative position and the tilting movement of the fin effected electro-hydraulically as is movement of the fin about a generally vertical axis to and from the operative position.

One of the main features of the stabilising system of U.S. Pat. No. 2,979,010 concerns the control of the electro-hydraulic tilting of each fin to vary the lift force exerted thereby. Each fin shaft is hollow and carries internally a cantilever beam or quill the free end of which moves upon flexure of the fin shaft due to lift forces exerted thereon in use of the fin. Transducer means are associated with the quill and provide an electrical signal representative of fin lift force which signal is applied as a feedback signal in opposition to a control signal for a hydraulic actuator operable to effect tilting of the fin in the desired direction, the control signal being derived from a device responsive to roll of the ship. Thus the electro-hydraulic control of each fin operates not to produce a displacement of the fin which is always the same for a given control signal even if the speed of the ship changes, but to produce a displacement of the fin in such a mannner that lift force exerted thereby is always the same for a given control signal. This feature of the prior stabilising system has proved to be all important in providing an accurate and viable system.

However, the embodiment of this feature in the system disclosed in U.S. Pat. No. 2,979,010 has been found to result in two main disadvantages, the first of which is that the hydraulic actuator for each fin extends generally vertically and operates on a lug extending radially from the fin shaft. The actuator has to be mounted externally of a casing housing the fin shaft and, therefore, requires relatively large head room to accommodate the necessary length of piston rod. This can often be a problem if the fins have to be sited close to a deck which may then have to be apertured to accept the actuator, possibly resulting in valuable personnel or other accommodation being lost. The second disadvantage is that the cantilever beam or quill and associated transducer means are housed within the fin shaft casing and are totally inaccessible from within the ship, together with the fin shaft itself and any other components disposed within the casing. Even if some limited access were possible, a prerequisite would be the removal of the hydraulic actuator for effecting fin tilt which is not a practicable proposition. Accordingly, it is necessary to dry-dock a ship if any maintenance or repair to the components mounted within the fin shaft casing is required, and any unscheduled dry-docking is extremely costly.

According to the present invention a ship stabilising system comprises one or more fins which, when in an operative position, extend outwardly from the ship below the water-line thereof, and one or more boxes in which the respective fins are mounted and one wall of each of which is attachable to the hull of the ship so as to be substantially flush therewith, each fin having a main body portion supported at the inner end by a shaft, means attached to the fin shaft and operable to tilt the fin about the longitudinal axis of the fin shaft, means operable to move the fin about a generally vertical axis from a stowed position in which it lies within the box, and within the hull of the ship, to the operative position, and vice versa, and a casing which houses the fin shaft and associated components and is rotated on movement of the fin to and from the operative position, the casing being mounted for rotation in upper and lower bearings provided in top and bottom walls, respectively, of the associated fin box, the upper and lower bearings being so dimensioned that access can be gained therethrough to the fin shaft and associated components mounted within the casing.

The fin shaft may be hollow and have mounted therein a cantilever beam or quill the free end of which is movable upon flexure of the fin shaft resulting from lift forces exerted on the fin in use of the system,transducer means being provided in association with the cantilever beam to produce an electrical signal representative of the fin lift force. The use of a cantilever beam provides amplification of the sensed flexure of the fin shaft sufficient to obtain an acceptable magnitude of output signal from the transducer means, which may be in the form of an electro-magnetic linear pick-off device. However, with the advent of more sophisticated devices, such mechanical amplification is no longer necessary and whilst the cantilever beam arrangement is entirely satisfactory, it may be replaced, for example, by strain gauges mounted directly on the fin shaft or bearing supports for the latter, or by other transducers operable to sense the fin lift force and provide an electrical output signal representative thereof.

The means for tilting each fin may comprise a pair of double-acting hydraulic cylinders housed within the casing in which the fin shaft is mounted, the cylinders being respectively connected to diametrically opposed connection points provided on the fin shaft. Thus the invention, according to one embodiment, provides an extremely compact fin mounting assembly which avoids the previous problem of having to provide relatively large head room but which gives manual access from within the ship to all mechanical and electrical components mounted within the fin shaft casing. Thus, all maintenance, setting-up and routine tests and adjustments can be made whilst the ship is in service. It will be appreciated that various mechanisms may be employed for tilting each fin and that the important point is that if the chosen mechanism can be mounted within the fin shaft casing to give the desired compactness, it is still accessible from within the ship in accordance with the main feature of the present invention. In the case of the use of a pair of double-acting hydraulic cylinders, these may be balanced so as to impart, in operation, substantially no bending forces to the fin shaft which forces may be sensed by strain gauges or other devices used to detect fin lift force as discussed above, with consequential loss in accuracy.

Each fin traverses through about 90° in moving from an inoperative position to the operative position, and vice versa, and means may be provided for locking the fin in each of these positions. In one embodiment, locking means may comprise an extension of the fin shaft casing in which are formed a pair of apertures angularly displaced apart by about 90° about the axis of rotation, each aperture being tapered to receive, when aligned therewith, a correspondingly tapered pin carried by a device fixed to the fin box. The means operable to remove each fin to and from the operative position may comprise a pair of double-acting hydraulic cylinders attached to respective diametrically opposed points on the fin shaft casing. The connection of each cylinder to the corresponding point on the fin shaft casing is preferably by way of a shear pin so that should the associated fin strike an object whilst in the operative position with sufficient force, the shear pins will shear, thereby permitting the fin to fold under the force of impact with the object to a position in which it clears the object, thereby minimising damage to the fin. When fin locking means are employed, such as the tapered pin arrangement mentioned above, this too is then arranged to shear, or otherwise be released, upon the fin striking an object.

The wall of the fin box attachable to the hull of the ship is provided with a slot through which the associated fin passes on moving to and from the operative position, and a main aperture necessary to mount the fin shaft casing within the fin box.

In order to improve the hydrodynamic efficiency of the fin, means may be provided to close the main aperture, as far as is possible, when the fin is in the operative position. If the main aperture is left open, the flow of water therein detracts from the hydrodynamic efficiency of the fin. Closure means for the main aperture may be in the form of a plate attached to the fin shaft casing which effectively closes the main aperture when the fin is in the operative position. A further closure plate, also attached to the fin shaft casing, may be provided to close the main aperture when the fin is in the inoperative position.

Figure 3:
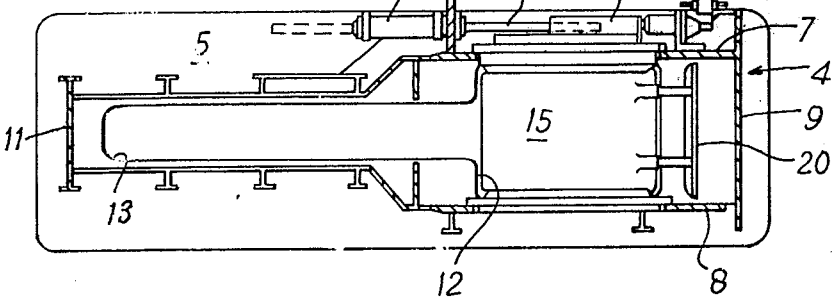
Figure 2:
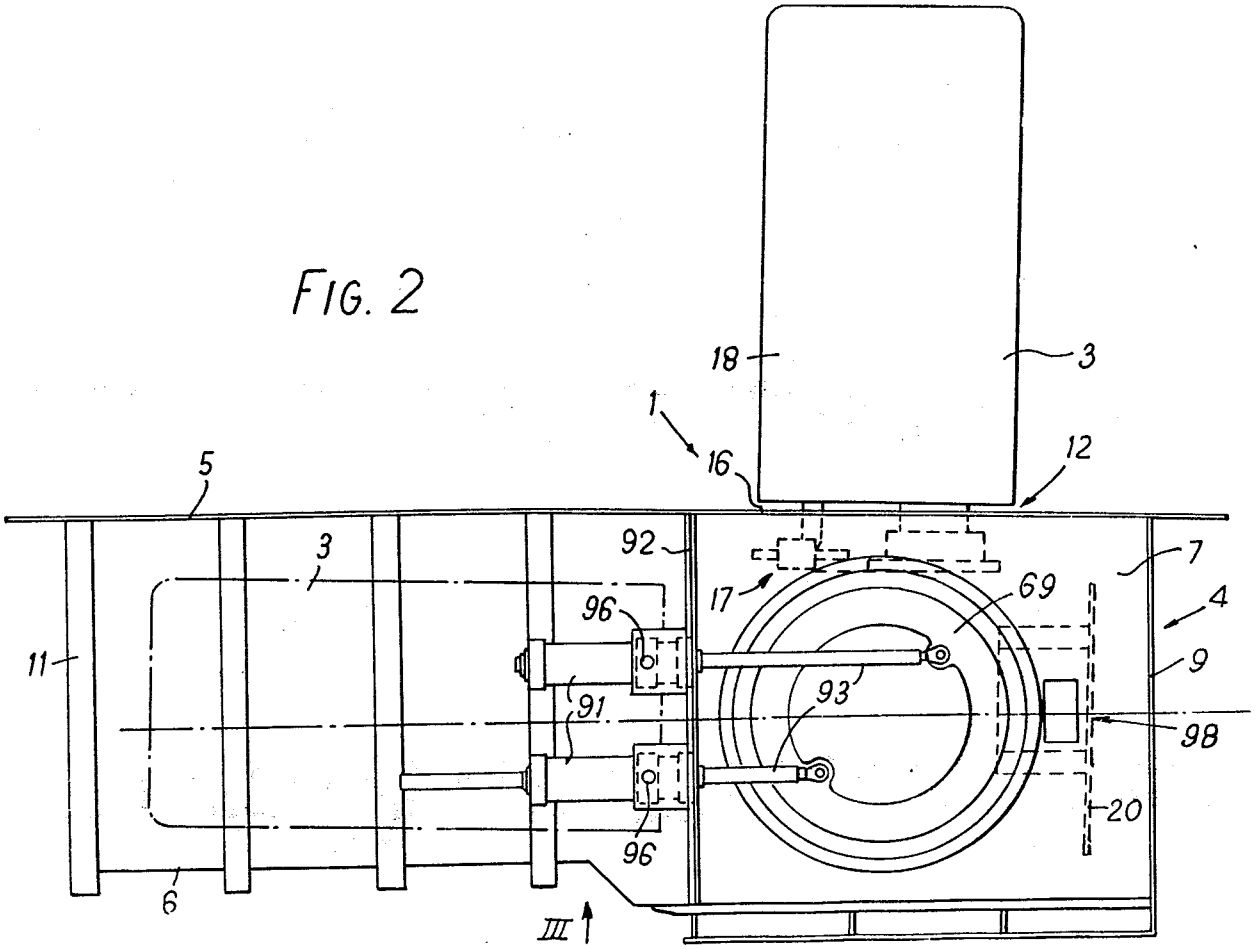
Figure 4:
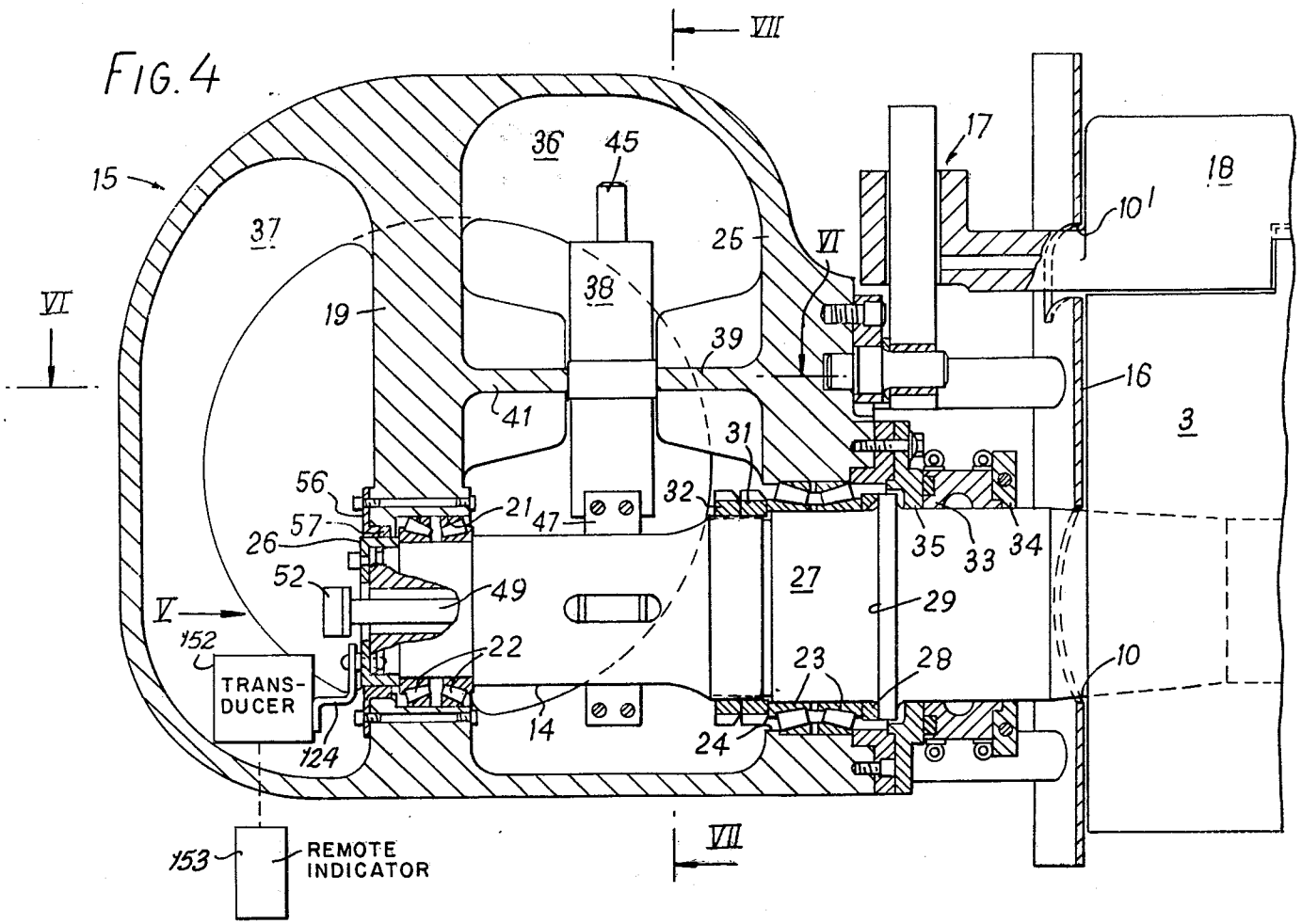
Figure 5:
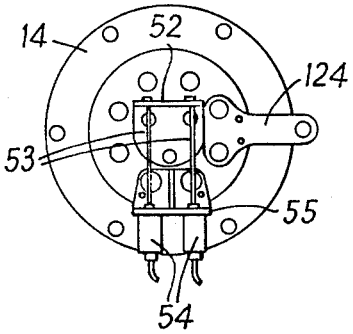
Figure 6:
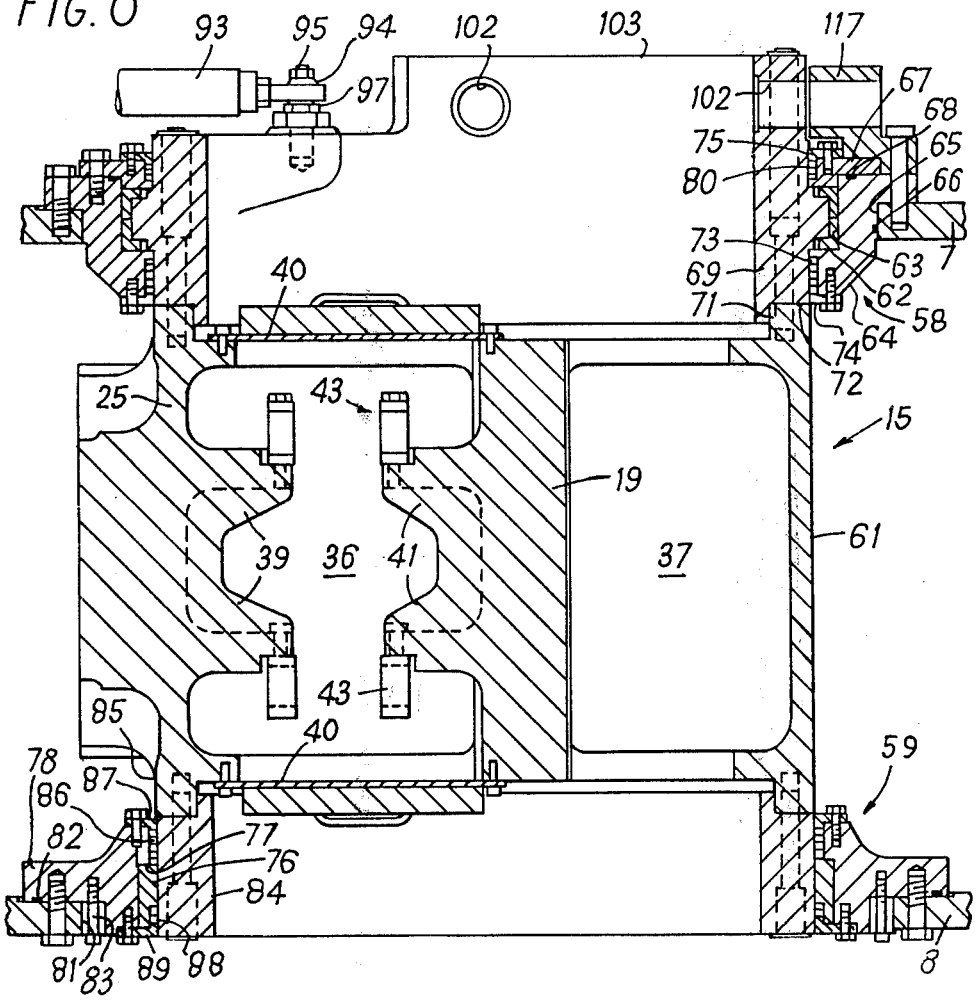
Figure 7:
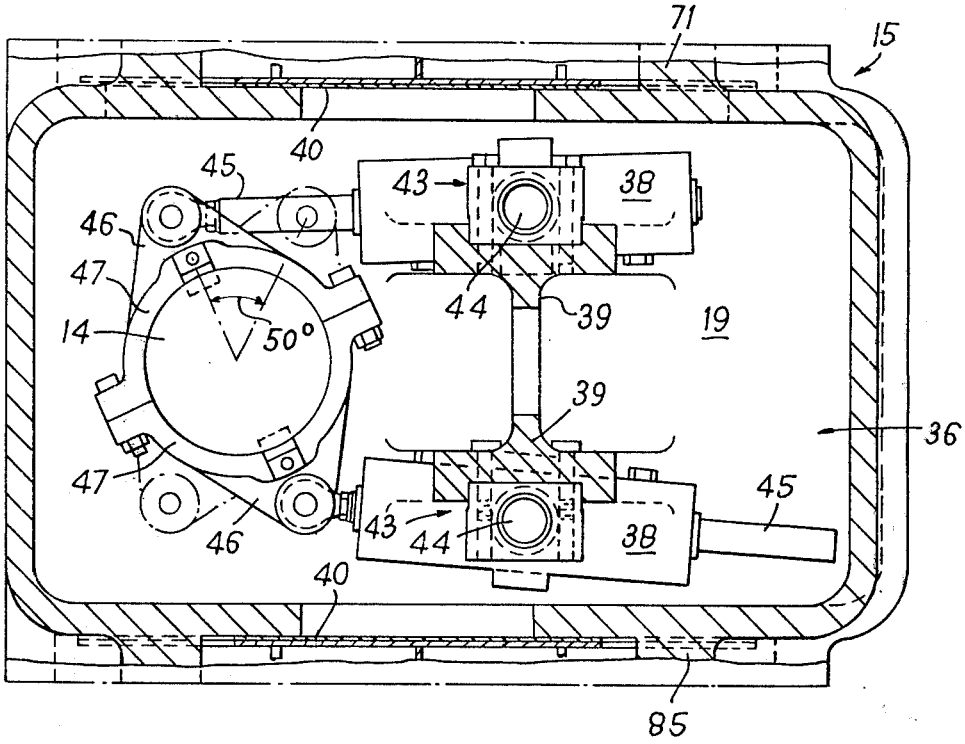
Figure 8:
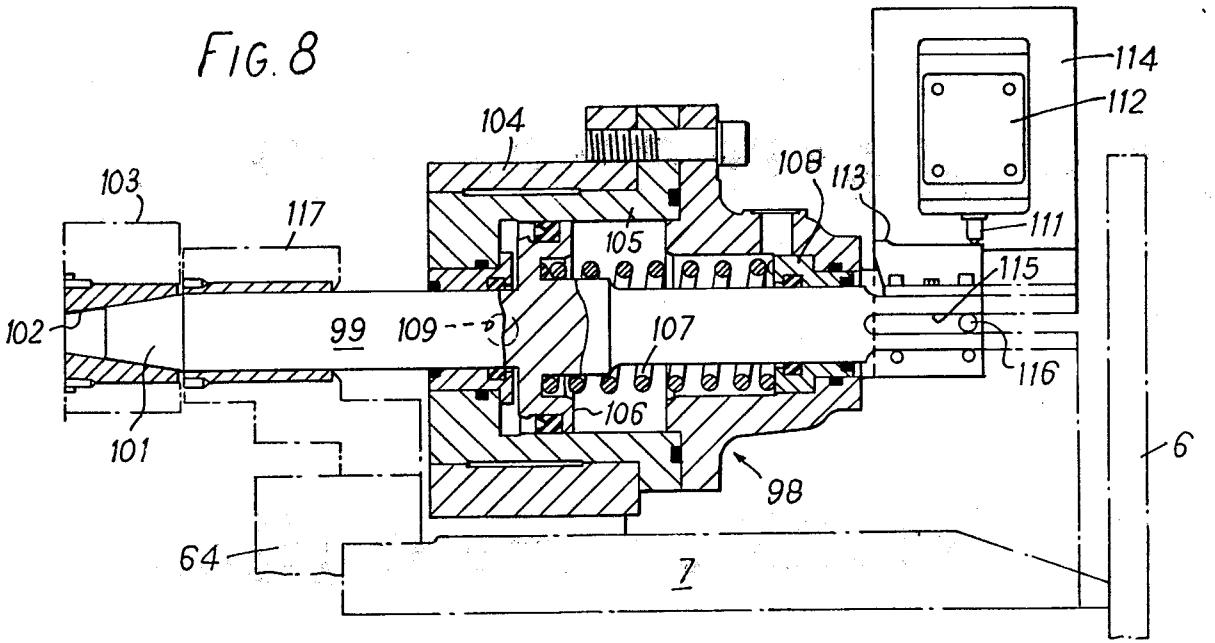
Figure 9:
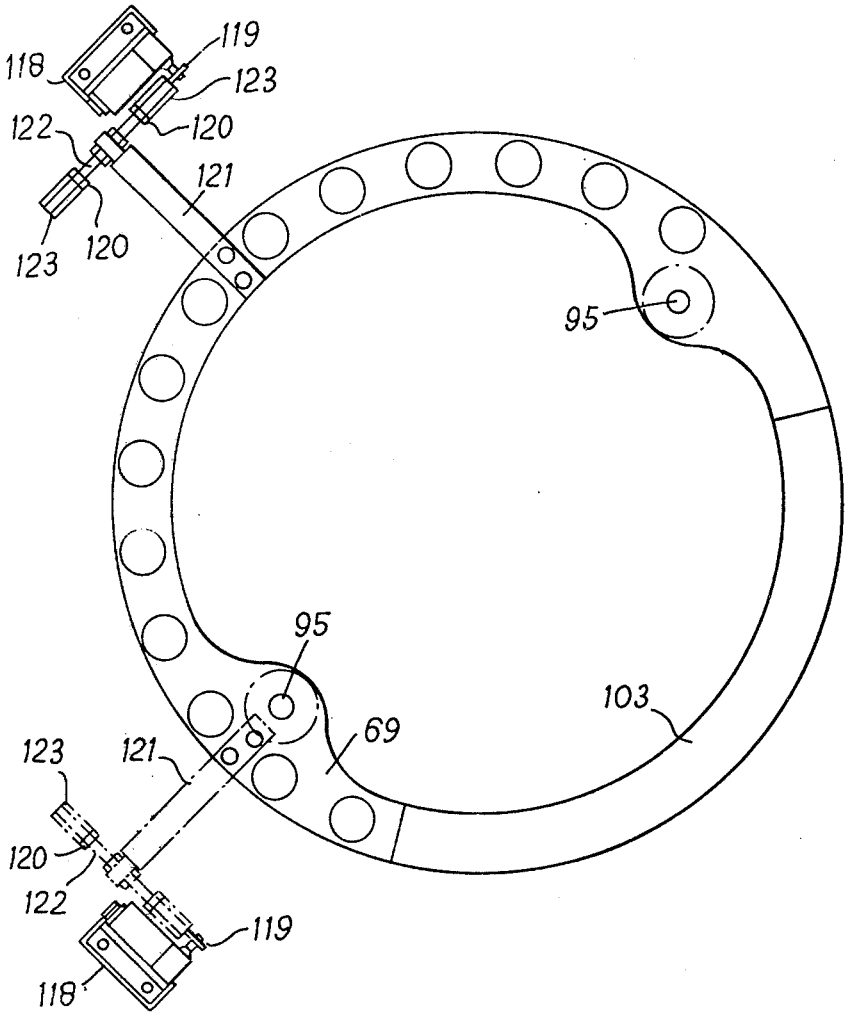
Figure 10:
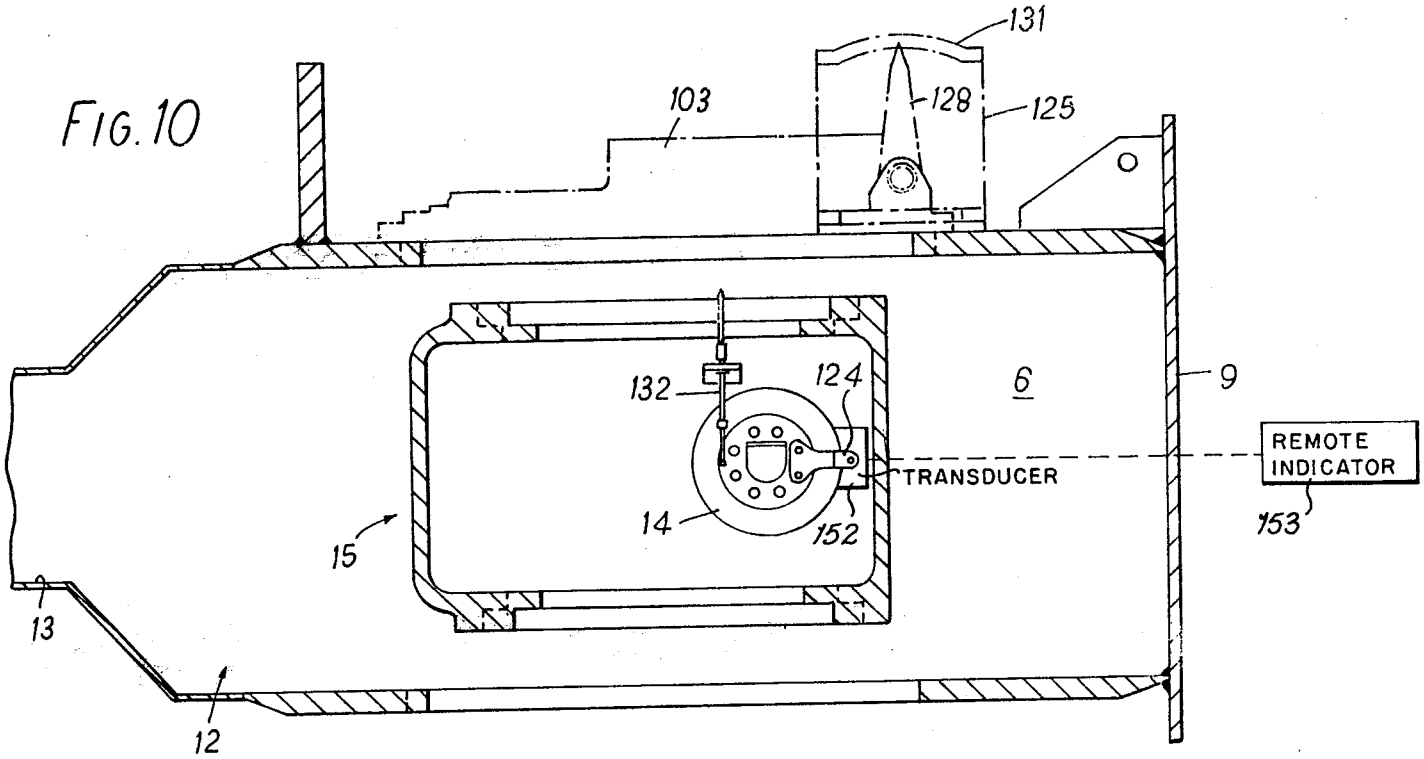
Figure 12:
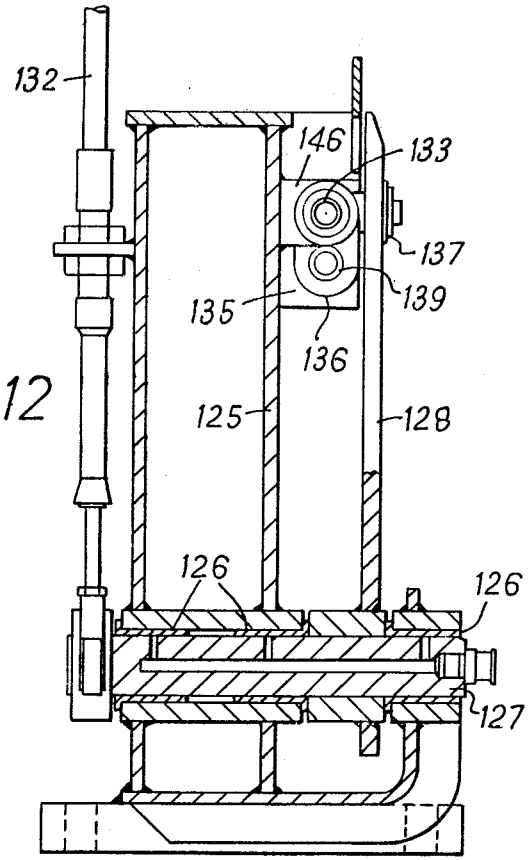
Figure 11:
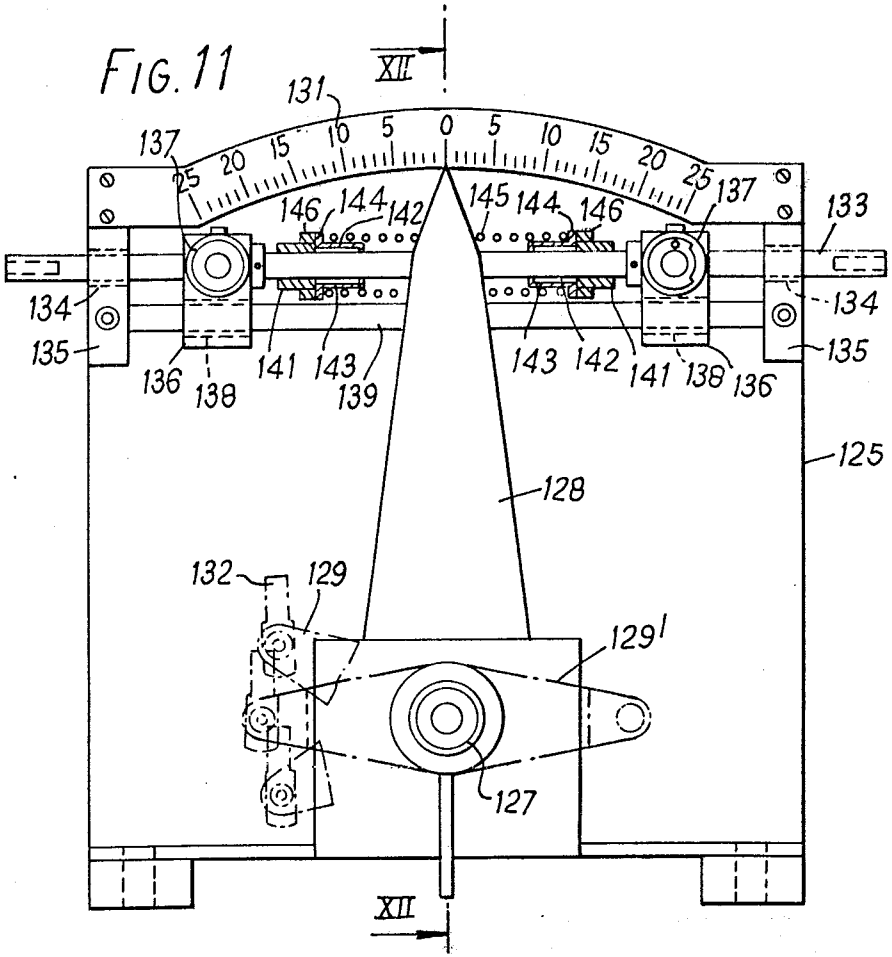

A ship stabilising system in accordance with the invention will now be described in greater detail, by way of example, with reference to the accompanying drawings, in which:

FIG. 1 is a simplified side elevation of one activated fin (the port fin) of the stabilising system, with the fin shown in the operative position, FIG. 2 is a plan view of FIG. 1, FIG. 3 is a view, to a different scale, in the direction of arrow III of FIG. 2, with certain parts removed, FIG. 4 is a section on the line IV—IV of FIG. 1, FIG. 5 is a view in the direction of arrow V of FIG. 4, FIG. 6 is a section on the line VI—VI of FIG. 4, FIG. 7 is a section on the lines VII—VII of FIG. 4, FIG. 8 is a sectional view of a locking device for the fin, FIG. 9 is an enlarged view of part of FIG. 2, FIG. 10 is a view generally similar to that of FIG. 3 but with certain parts removed and with the fin in the operative position, FIG. 11 is an elevation, to a larger scale, of a detail of FIG. 10, and FIG. 12 is a section on the line XIII—XIII of FIG. 11, FIG. 13 is an elevation to a larger scale of a detail of FIG. 4.

The stabilising system comprises two activated fin assemblies 1 disposed on opposed sides of the hull 2 of the ship to which the system is fitted, below the water line, and two elctro-hydraulic control units (not shown) associated with respective fins. For convenience, only the port fin assembly 1 is shown in the drawings and described since the starboard fin assembly is identical to, although the mirror image of, the port assembly. The system illustrated in the drawings has been designed for ships of about 2,000 tons displacement, but may be scaled up or down to suit vessels of greater or lesser displacement.

As can be seen from FIG. 1, each fin assembly 1 is mounted within the hull 2 of the ship such that the actual fin 3 is inclined to the horizontal, the amount of inclination being predetermined having regard to the size of ship concerned and other design parameters. Each fin assembly 1 includes a fin box 4 having an outer wall 5, inner wall 6, top wall 7, bottom wall 8, front wall 9 (FIG. 2) and rear wall 11 (FIG. 2) all of steel plate and welded together to form the box. The outer wall 5 extends past the top and bottom walls 7, 8 and front and rear walls 9, 11 and is welded around its periphery to a correspondingly dimensioned aperture in the hull 2 so as to lie substantially flush therewith. As can be seen from FIG. 3, the outer wall 5 of the fin box 4 has a keyhole-type aperture formed therein comprising a main aperture 12 and a slot 13.

The fin assembly 1 further comprises the actual fin 3 already referred to which is supported at the inner end by a hollow shaft 14, and a casing 15 which houses the major portion of the fin shaft 14 and other components which will be described hereinafter. The longitudinal axis of the fin shaft 14 is offset with respect to the longitudinal axis of the fin 3. The fin shaft casing 15 is assembled through the main aperture 12 in the outer fin box wall 5 and the fin 3 passes through the slot 13 in moving from a stowed, inoperative position (shown in phantom in FIG. 2) to an operative position (shown in full lines in FIG. 2), and vice versa. When the fin 3 is in the operative position it extends outwardly from the hull 2 of the ship as seen both in FIGS. 1 and 2, and when in the inoperative position it lies within the fin box 4 and hence within the hull of the ship. In order to increase the hydrodynamic efficiency of the fin 3 when in the operative position, the main aperture 12 in the fin box outer wall 5 is closed as far as is possible by a plate 16 carried by the fin shaft casing 15. The plate 16 is made in two parts and fitted after the fin 3 has been assembled, the two parts being welded together and apertured at 10 and 10′ (FIG. 4) to accommodate the through passage of the fin shaft 14 and an actuator 17 for a flap 18 forming the trailing edge of the fin 3 and hinged with respect to the main body of the fin. The plate 16 effectively prevents water flowing through the main aperture 12 which would otherwise adversely affect the hydrodynamic efficiency of the fin 3. Desirably, the main aperture 12 is also closed when the fin 3 is in the inoperative position and the fin shaft casing 15 carries a further plate 20 to this end.

Turning now to the more detailed FIGS. 4 to 7 of the drawings, the fin shaft casing 15 has a cast body and is dimensioned so as to take up substantially all of the available space in the fin box 4 at the end at which it is situated. In this connection, it will be appreciated that the width of the main aperture 12 in the fin box wall 5 is dictated by the dimension of the chord of the fin 3 which in turn is dictated by the maximum lift force which the fin must be designed to provide. Likewise, the depth of the fin box 4 is dictated by the dimension of the chord of the fin 3. As will be seen from FIGS. 4, 6 and 7, the casing 15 is generally square in plan view and rectangular in side elevation, it being smaller in height than in width. A transverse web 19 is cast integrally with the walls of the casing 15 and is apertured at 21 to receive the inner end of the fin shaft 14. The fin shaft 14 is rotatably supported in the web 19 by a pair of taper bearings 22. A further pair of taper bearings 23 support the fin shaft 14 at a point spaced from the inner end thereof, namely the point at which the shaft passes through an aperture 24 in a wall 25 of the casing 15. The pair of bearings 22 fits around a reduced diameter portion of the fin shaft 14 and is held against the step formed by the reduced diameter by a thrust ring 26 bolted to the inner end of the fin shaft. The pair of bearings 23 is fitted around an increased diameter portion 27 of the fin shaft 14 and is held against a spacer 28, in turn abutting a step 29 on the fin shaft, by a thrust ring 31 secured by a locking nut 32.

Since the four side walls of the casing 15 are open to the sea in service of the ship, adequate sealing against ingress of sea water through the aperture 24 in the wall 25 has to be provided. This sealing in the main takes the form of a so-called deep sea seal comprising an annular sealing member 33 disposed around a portion of the fin shaft 14 and attached at one end to an annular retaining ring 34. The other end of the sealing member 33 is in rubbing contact with an annular rub plate 35 bolted to the wall 25 of the fin shaft casing 15. Thus on rotation of the fin shaft 14 about the longitudinal axis thereof, the sealing member 33 and retaining ring 34 rotate therewith, the sealing member rubbing on the adjacent face of the rub plate 35 to effect the necessary seal. The web 19 divides the fin shaft casing 15 into two chambers 36 and 37 and the chamber 36 is filled with oil, being provided with upper and lower cover plates 40 (FIGS. 6 and 7), which assists in resisting ingress of sea water.

The rotation of the fin shaft 14 referred to is required to effect tilting of the fin 3 to vary the lift imparted thereby to the ship by way of the hull 2. Rotation or tilting is effected by a pair of double-acting hydraulic cylinders 38 mounted within the chamber 36 of the casing 15, one beneath the other. Each of the cylinders 38 is carried between two brackets in the form of respective integral extensions 39,41 of wall 25 of he casing 15 and of the face of the web 19 part-defining the chamber 36 of the casing. The cylinders 38 are mounted between the extensions 39,41 by bearing blocks 43 which receive respective pivot pins 44 attached to the cylinders to permit rotational movement of the latter in a vertical plane. The piston 45 of each cylinder 38 is pivotally attached at one end to a lug 46 (FIG. 7) extending radially from the fin shaft 14, the two lugs 46 being diametrically opposed and formed on semi-circular clamps 47 clamped and keyed to the fin shaft. The two cylinders 38 are balanced so that they exert equal pressures on the fin shaft 14 when tilting or rotating the latter. Thus a substantially pure couple is imparted to the fin shaft 14 by the pulling action of one cylinder and the pushing action of the other, or vice versa, as appropriate, whereby the fin shaft is subjected to little or no bending forces which is a significant feature as will be explained hereinafter. The required full range of movement of the fin 3 is 50°, i.e. 25° to each side of the null or horizontal fin position. Thus the cylinders 38 only have to operate over this angular range, one extreme of fin tilt being shown in full lines in FIG. 7 and the other extreme being shown in phantom. It is because the ends of the pistons 45 attached to the lugs 46 have arcuate loci when operating to tilt the fin shaft 14, and hence the fin 3, that the pivotal mounting of the cylinders 38 via the pivot pins 44 is necessitated.

The inner end of the fin shaft 14 terminates flush with the face of the web 19 part-defining the chamber 37 of the fin shaft casing 15 and has mounted within it a cantilever beam or quill 49 of tubular construction and attached to the interior of the fin shaft at the increased diameter portion 27. The free and inner end of the beam 49 extends past the inner end of the fin shaft 14 and carries a bracket 52 to which are attached ends of two rods 53 as shown in FIG. 5. The other ends of the rods 53 are attached to respective transducers 54 mounted on a bracket 55 also attached to the fin shaft. The transducers 54 are electro-magnetic linear pick-off devices such as disclosed in the stabilising system of U.S. Pat. No. 2,979,010 and provide electrical output signals representative of the lift force being produced by the fin 3. These signals are used as a feedback signal in opposition to a control signal derived by a device responsive to roll of the ship in a manner similar to that described in U.S. Pat. No. 2,979,010 and which will not be further discussed here since it forms no part of the present invention as such. The fin lift force is measured by detecting the consequential flexure of the hollow fin shaft which flexure is amplified by the cantilever beam 49 to ensure a sufficiently large output signal from the transducers 54. However, the beam 49 and transducers 54 may be replaced by strain gauges mounted directly on the fin shaft 14, for example. Strain gauges are available which will provide an output signal of adequate magnitude in response to fin shaft flexure. However, when such, or similar, devices are used directly on the fin shaft 14, it is important that the latter is not subjected to any bending forces other than those occasioned by the fin lift force and that is why the fin tilt cylinders 38 are designed to provide a substantially pure couple on the fin shaft 14 as already described.

As already mentioned, a bearing thrust ring 26 is attached to the inner end of the fin shaft 14 and this fits within a retaining ring 56 for a lip seal 57 provided to prevent seepage of oil from the chamber 36 of the casing 15 to the chamber 37.

With particular regard to FIG. 6, the fin shaft casing 15 is mounted for rotation between the top and bottom walls 7,8 of the fin box 4, this being necessary to permit movement of the fin 3 to and from the inoperative position. Upper and lower casing bearings 58,59 are provided which are substantially the same diameter as the width of the casing between the wall 25 and the opposed wall 61, that is, the bearings are made as large as possible so as to define as large a space as possible through which manual access may be gained to the chambers 36 and 37 of the casing. The upper bearing 58 is a double-thrust flange bearing 62 designed to take the full weight of the casing 15 and fin 3. The flange bearing 62 is located in a recess 63 of an annular flanged bearing housing 64 bolted to the top wall 7 of the fin box 4 and sitting in an aperture 65 formed in the latter. A ring seal 66 is provided between the bearing housing 64 and the face of the aperture 65. A thrust ring 67 bolted to the bearing housing 64 retains the flanged bearing 62 in position, and a ring seal 68 is fitted between the housing and thrust ring. A hub 69 is bolted to an upstanding annular collar 71 formed integrally with the casing 15, a ring seal 72 being fitted therebetween. Packing 73 is provided between the bearing housing 64 and the hub 69, retained by a gland ring 74 bolted to the housing. Further packing 80 is provided between the hub 69 and the thrust ring 67, retained by a gland ring 75 bolted to the latter.

The lower casing bearing 59 is in the form of a sleeve or bush bearing 76 located in a recess 77 of a flanged bearing housing 78 and retained therein by a locking screw. The bearing housing 78 is bolted to the bottom wall 8 of the fin box 4 and sits in an aperture 81 formed therein, a ring seal 82 being fitted between the housing 78 and the inner or upper face of the bottom wall 8 of the fin box 4. A centralizing segment 83 is provided to facilitate the accurate fitting of the lower bearing 59. A hub 84 is bolted to a depending annular collar 85 formed integrally with the casing 15. As with the upper bearing 58, packing 86 is provided between the bearing housing 78 and the hub 84, retained by a gland ring 87. Further packing 88 is provided between the bearing 76 and the hub 84, retained by a gland ring 89 bolted to the bearing housing 78.

It is thus seen that the fin shaft casing 15 is rotatably mounted in the fin box 4, adequate seals being provided in the bearings 58 and 59 to prevent sea water escaping from the interior of the fin box 4 to the shipboard side of the top and bottom fin box walls 7,8. Hence, the interior of the casing 15 is sealed from sea water and is accessible from within the ship both from the top and the bottom.

Rotation of the fin shaft casing 15, together with the fin 3, is effected by a pair of double-acting hydraulic cylinders 91 (FIG. 2) mounted on a crosshead 92 fixed to the upper (shipboard) side of the top wall 7 of the fin box 4. The pistons 93 of the cylinders 91 are pivotally attached via bearings 94 (FIG. 6) to respective pivot pins 95 fixed to the upper face of the hub 69 of the upper casing bearing 58. The pivot pins 95 are diametrically opposed and since they have arcuate loci on rotation of the fin shaft casing 15, the cylinders 91 are mounted for pivotal movement in a generally horizontal plane about pivot pins 96 (FIG. 2). Each pivot pin 95 is formed as a shear pin and has a neck 97 at which shearing takes place if the fin 3 strikes an object with sufficient force when in the operative position. The fin shaft casing 15 traverses through approximately 90° when the fin 3 is moved by the push-pull action of the cylinders 91 from the operative to the inoperative position, or vice versa.

It is necessary to lock the fin 3 both in the operative and inoperative positions and locking means 98 are provided as shown in FIG. 8. The locking means 98 essentially comprise a locking pin 99 having a tapered end 101 which cooperates with one or other of two tapered apertures 102 formed in an upstanding arcuate extension 103 of the hub 69 of the upper casing bearing 58, when the pin and corresponding aperture are aligned at the end of rotational movement of the casing 15 following the rigging of the fin 3 to or from the operative position. The pin 99 is mounted for axial movement within a housing 104 bolted to the bearing housing 64 of the upper casing bearing 58, part of the housing 104 being in the form of a hydraulic cylinder 105. The pin 99 is formed with a portion 106 of increased diameter which constitutes a piston operable within the cylinder 105. A compression spring 107 acts between the piston portion 106 of the pin 99 and an end 108 of the cylinder 105 to urge the pin to the position in which the end 101 engages one or other of the apertures 102.

Hydraulic pressure fluid is admitted to the left-hand side of the piston 106 (as seen in FIG. 8) through a port 109 when it is required to release the pin 99 from its operative position shown in FIG. 8. Pressure fluid moves the piston 106, and hence pin 99, to the right against the action of the spring 107 until the pin is retracted from the previously engaged aperture 102, which position is sensed by a spring loaded member 111 of an electro-hydraulic valve 112 in association with a cam surface 113 provided on the right-hand end of the pin 99. The valve 112 is mounted on a bracket 114 and the right-hand end of the pin 99 is slotted at 115 to receive a pin 116 which bottoms on the slot to provide an end stop for the pin. The valve 112 primarily provides an overriding control of pressure fluid to the rigging cylinders 91 so that operation of the latter is not possible when the pin 99 is in the operative position, i.e. in engagement with an aperture 102. Thus when the member 111 is in the position shown in FIG. 8, the cylinders 91 cannot be energised. However, when the pin 99 has been retracted, the member 111 is depressed by the cam surface 113 and switches the valve such as to permit flow of pressure fluid to the cylinders 91 to effect required rigging. When rigging is complete whereupon the aperture 102 now previously engaged is aligned with the pin 99, pressure fluid is vented from the cylinder 105, whereby the pin 99 is moved to the left under the action of the spring 107 into engagement with the aligned aperture 102. This movement of the pin 99 desengages the cam surface 113 from the valve member 111 which then moves back to the position shown in FIG. 8 in which the valve again prevents any flow of pressure fluid to the cylinders 91.

Various hydraulic seals are provided in the locking means 98 as shown and it will be seen that the pin 99 is supported for axial movement at each end of the housing 104 and by a bearing 117 mounted on the bearing housing 64 of the upper casing bearing 58. Since the pivot pins 95 connecting the pistons 93 of the cylinders 91 to the casing 15 are formed as shear pins, then the pin 99 has to be similarly designed since it is in engagement with the corresponding aperture 102 when the fin 3 is in the operative position and hence has to be made to shear also, in addition to the pivot pins 95, to enable this safety feature fully to be implemented. Should the fin 3 strike an object with such a force as to shear the pivot pins 95 and the locking pin 99, the casing is then free to rotate about the upper and lower bearings 58, 59 allowing the fin to fold clear of the object it has encountered, thereby minimising damage to the fin.

It will be appreciated that the locking pin 99 can only be engaged with the required aperture 102 when the two are aligned and there is essentially no relative movement between the casing 15 and the locking device 98. Thus, it is necessary to control flow of pressure fluid to the rigging cylinders 91 very accurately and to arrest the same when the pin 99 and corresponding aperture 102 are aligned. To this end, limit switches 118 (in the form of microswitches) are mounted on the top wall 7 of the fin box 4 (FIG. 9). Each switch 118 has a pivotal actuating arm terminating in a roller 119 engageable by a switch-actuating member 121 attached to and extending generally radially from the hub 69 of the upper casing bearing 58. The member 121 is T-shaped and the cross-piece 122 thereof is threaded to receive two collars 123 and associated lock outs 120 at respective ends. The threaded connection for the collars 123 is provided so that fine adjustment can be made to the position thereof on the cross-piece 122 and hence to the point at which the roller 119 of the associated switch 118 is engaged to ensure alignment between the locking pin 99 and one or other aperture 102 before the pin is released. As seen in FIG. 9, the upper switch 118 is engaged and actuated by one collar 123 and when such engagement is effected, the flow of pressure fluid to the cylinders 91 is arrested and the pressure fluid is vented from the cylinder 105 of the locking means 98 to release the locking pin 99 from the retracted position.

When the next rigging of the fin 3 is required, the locking pin 99 is retracted from the engaged aperture 102 as previously decribed and the cylinders 91 activated so as to rotate the casing 15 and fin 3 through approximately 90°. As this rotation is effected, the upper switch 118 will be disengaged by the associated collar 123 as the member 121 is carried round with the casing 15. Eventually, the other collar 123 engages the lower switch 118 (as shown in phantom in FIG. 9), whereupon the cylinders 91 are de-energised and the locking pin 99 released to engage the now aligned other aperture 102.

As the stabilising system is based on the philosophy of measuring fin lift force and using a signal representative thereof to order fin tilt, there is no basic requirement as regards fin tilt control to know the precise disposition or angle of tilt of the fin 3 during normal stabilising operations. However, there is a need for a system control mode based on the angle of fin tilt since the system has to be tested on initial installation and following maintenance or repair when the ship is either in dry dock or in water but stationary or very slow moving, in which instances the fin lift cntrol mode cannot be employed since there is no water flowing over the fins. Thus a transducer 152 such as a synchro is provided which is coupled to the inner end of the fin shaft 14, by a lever 124 as shown in FIGS. 4 and 10. On rotation of the fin shaft 14 to effect fin tilt, the lever 124 rotates also and operates the synchro which produces a signal representative of the magnitude and sense of fin tilt which signal can be used in the control of the stabilising system on the basis that a given fin tilt angle will produce a certain lift force. This fin tilt angle mode of control can, of course, be employed as the prime control in the normal operation of the stabilising system if the fin lift force mode of control becomes inoperative but the latter mode is much preferred since it provides actual lift force irrespective of precise fin tilt angle rather than vice versa as in the fin tilt angle control mode. The signal from the transducer 152 such as a synchro may additionally be used to display fin tilt angle on a remote indicator 153 as shown in FIGS. 4 and 10 on the bridge of the ship and/or other required point. Likewise the output signals from the transduces 54 may additionally be used to display the lift forces actually being exerted by the fins.

It has already been mentioned that the full angular range of fin tilt is 25° to each side of a nominal or null position in which the fin is substantially horizontal, ignoring the downward tilt thereof although this range could be greater depending on the required design. Clearly, the fin must be in the null or substantially zero tilt position before it is rigged to or from the operative position so that an indication of the fin tilt angle is essential.

A mechanical fin angle indicating system is disposed on the fin box 4, a bracket 125 (FIGS. 10 to 12) being bolted to the top wall 7 of the fin box 4 and carrying bearings 126 for a spindle 127 to one end of which is attached one end of a pointer 128 and to the other end of which is connected a radially-extending lug 129. The tip of the pointer 128 is movable over a scale 131 mounted on the bracket 125 and graduated in degrees from a central zero to 25° at either end. A Morse cable assembly 132 is attached at one end to the lug 129 and at the other end to the inner end of the fin shaft 14 (FIG. 10). On rotation of the fin shaft 14, the cabe 132 is either pushed or pulled, thereby effecting rotation of the spindle 127 in one direction or another, via the lug 129, and correspondingly moving the tip of the pointer 128 over the scale 131 to indicate the fin tilt angle. The central and two extreme positions of the lug 129 are indicated in FIG. 11, the central position of the lug for the starboard fin assembly being shown at 129'.

It is necessary to provide means to limit the fin tilting movement to within the required range of 25° to each side of the null position and limiting means are embodied in the mechanical fin angle indicating means. A rod 133 is mounted for axial movement in two bushes 134 provided in respective plates 135 extending from the bracket 125. Secured to the rod 133 towards either end are two supports 136 each carrying a roller 137. Bushes 138 are provided in each support 136 which receive a guide rod 139 attached at each end to the respective plates 135. Two collars 141 are attached to the shaft adjacent the respective supports 136, and a bush 142 is provided on the rod 133 adjacent each collar 141 on the side thereof remote from the associated support 136. A flanged spring cup 143 is provided over each bush 142 against the flange 144 of which acts one end of a compression spring 145 which thus acts between the two cups 143 to retain them against the corresponding collars 141 and, in the zero angle position, also against collars 146 slidably mounted over the associated collars 141 and fixed to the bracket 125 as seen in FIG. 12.

If the pointer 128 is moving to the right as seen in FIG. 11, it will do so freely until it engages the right-hand roller 137. Further movement to the right of the pointer 128 results in movement to the right of the rod 133 via the roller 137 and support 136. Carried with the rod 133 is the right-hand collar 141 and the left-hand collar 141, bush 142 and cup 143. However, the right-hand cup 143 is prevented from moving by the associated stationary collar 146, whereby the spring 145 is compressed thereagainst. One end or other of the rod 133 (depending on whether the port or starboard fin is involved) is connected to a cable or other mechanical means (not shown) which is actuated on movement of the rod 133 and is arranged progressively to reduce the hydraulic pressure or flow from the associated hydraulic power unit, whereby the motion of the fin tilt cylinders 38 is arrested before the maximum fin tilt angle is exceeded. When the fin 3 is tilted in the opposite direction, the spring 145 expands and therefore acts as a pointer centralising device. It will be appreciated that movement to the left of the pointer 128 will eventually bring into action the limiting action of the left-hand end of the rod 133 in a manner similar to that described for right-hand pointer movement.

The overall operation of the ship stabilising system described with respect to the accompanying drawings is generally similar to that described in U.S. Pat. No. 2,979,010 to which reference is made. Also U.S. Pat. No. 2,979,010 describes the operation of the fin flap actuator 17 to which only passing reference has been made herein.

It will be seen from the foregoing description that the present invention provides a stabilising system in which each fin assembly has a fin shaft casing 15 to which access to all of the working parts mounted therein is possible from within the ship through either or both of the upper and lower casing bearings 58,59 whereby the present invention constitutes a significant advance in the art of stabilising systems of the type with which it is concerned, namely the activated-fin type in which the fins are foldable about a generally vertical axis.

The chamber 37 of the fin shaft casing 15 is adequately large to maintain or repair all of the components housed therein, and the chamber 36 is even larger. Although the chamber 36 is fitted with cover plates 40 and filled with oil, the plates can be removed and the oil drained should it prove necessary to gain access to the fin tilt cylinders 38 or other components in the chamber 36. The disposition of the cylinders 38 in the fin shaft casing 15 gives rise to a further advantage, that of minimising the head room necessary to accommodate the fin assemblies. As the size of ship (about 2,000 tons displacement) for which the described stabilising system is designed is comparatively small, larger fin assemblies necessary for larger ships will enable larger fin shaft casings to be employed with correspondingly easier access to the interior thereof through the upper and lower casing bearings 58,59.

What we claim is:

1. A ship stabilising system comprising at least one retractable fin supported at one end by a shaft which, when in an operative position, extends outwardly from the ship below the water-line thereof, at least one box in which the respective fin is mounted, of the ship so as to be substantially flush therewith, means attached to the fin shaft and operable to tilt the fin about the longitudinal axis of the fin shaft including a pair of double-acting hydraulic cylinders housed within a fin shaft casing means, and diametrically opposed connection means provided on the fin shaft for pivotally connecting the respective cylinders to the fin shaft whereby said tilting means impart substantially zero bending moment to said fin shaft, means operable to move the fin about a generally vertical axis to and from a stowed position in which the fin lies within the box disposed within the hull of the ship, and to and from the operative position, said fin shaft casing means housing the major portion of the fin shaft, the means attached to the fin shaft and operable to tilt the fin about the longitudinal axis of the fin shaft, and associated components, said casing means being rotatable on movement of the fin to and from the operative position, and upper and lower bearing means being provided in top and bottom walls, respectively, of the associated fin box for accommodating rotation of said casing means, the upper and lower bearing means including bearings being so dimensioned whereby access can be gained therethrough from the interior of the ship to the fin shaft, the means operable to move the fin about a generally vertical axis, and the associated components mounted within the casing means.

2. A system as recited in claim 1, further including transducer means coupled to the fin shaft for sensing flexure of the fin shaft thereby providing an electrical signal representative of the fin lift force and wherein the pair of hydraulic cylinders are balanced so as to impart, in operation, substantially no bending forces on the fin shaft which may be sensed by the transducer means with consequential loss in accuracy in measuring fin lift force.

3. A system as recited in claim 1 further including locking means for locking said retractable fin in the stowed and operative positions respectively wherein the locking means includes an extension of the fin shaft casing having a pair of apertures angularly spaced about the axis of rotation, and means attached to said box including a pin which is engageable with one or other of the apertures in the extension thereby locking the fin in the corresponding position.

4. A system as recited in claim 3, wherein the pin is a shear pin arranged to shear upon the fin striking an object and being subjected to a force in excess of a predetermined minimum value, when in the operative position, whereby the fin becomes free to rotate towards the stowed position so as to clear the object.

5. A system as recited in claim 3 wherein the pin forms part of a piston operable in an hydraulic cylinder including resilient means for urging the piston in the direction of pin engagement with one or other aperture and pressure fluid means for retracting the piston in the hydraulic cylinder in a manner to move the piston against the action of the resilient means.

6. A system as recited in claim 5, wherein the pin is arranged to operate actuation means when moved to the retracted position whereby the actuation means provides energization of the means for moving the fin about a generally vertical axis only when operated by the pin.

7. A system as recited in claim 1 further including fin tilt angle measuring means enclosed within the casing means in the form of electrical transducer means coupled to the fin shaft for providing an output signal representative of the magnitude and sense of fin tilt.

8. A system as recited in claim 7 further including remote indicator means responsive to said electrical transducer output signal for providing one or more remote indications of fin tilt angle.

* * * * *

UNITED STATES PATENT AND TRADEMARK OFFICE

CERTIFICATE OF CORRECTION

PATENT NO. : 4,023,516

DATED : May 17, 1977

INVENTOR(S) : David Alexander Bennett

It is certified that error appears in the above-identified patent and that said Letters Patent are hereby corrected as shown below:

Regarding the Assignee, after [73] Assignee: cancel "Sperry Rand Corporation, New York, N.Y." and insert --Sperry Rand Limited, London, England--.

In Claim 1, line 6 thereof, after "mounted," insert the following: ---said box having at least one wall which is attachable to the hull--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*